US009327346B2

(12) United States Patent
Wang et al.

(10) Patent No.: US 9,327,346 B2
(45) Date of Patent: May 3, 2016

(54) METHOD FOR CURING COLD-BOX FOUNDRY SHAPE WITH GASEOUS CATALYST

(75) Inventors: Xianping Wang, Dublin, OH (US); Douglas J. Desmit, Greenwood, IN (US); Joerg Kroker, Powell, OH (US)

(73) Assignee: ASK CHEMICALS L.P., Wilmington, DE (US)

( * ) Notice: Subject to any disclaimer, the term of this patent is extended or adjusted under 35 U.S.C. 154(b) by 164 days.

(21) Appl. No.: 14/232,343

(22) PCT Filed: Jul. 19, 2012

(86) PCT No.: PCT/US2012/047351

§ 371 (c)(1),
(2), (4) Date: Jan. 13, 2014

(87) PCT Pub. No.: WO2013/013015

PCT Pub. Date: Jan. 24, 2013

(65) Prior Publication Data

US 2014/0190648 A1 Jul. 10, 2014

Related U.S. Application Data

(60) Provisional application No. 61/509,427, filed on Jul. 19, 2011.

(51) Int. Cl.

| | |
|---|---|
| ***B22C 9/12*** | (2006.01) |
| ***B22C 1/16*** | (2006.01) |
| ***B22C 9/02*** | (2006.01) |

(52) U.S. Cl.

CPC ..... *B22C 9/123* (2013.01); *B22C 1/162* (2013.01); *B22C 9/02* (2013.01)

(58) Field of Classification Search

CPC ..... B22C 1/16; B22C 1/162; B22C 9/123; B22C 9/02

USPC ..... 164/16, 159, 228

See application file for complete search history.

(56) References Cited

U.S. PATENT DOCUMENTS

2002/0129915 A1 9/2002 Lapeus
2010/0126690 A1 5/2010 Van Hemelryck

FOREIGN PATENT DOCUMENTS

GB 2024232 A 1/1980

OTHER PUBLICATIONS

Burditt, "Mold and Core Binders Keep Pace with Industry Demands", Modern Casting vol. 78, No. 6, pp. 20-24, American Foundry Society,Schaumberg, IL, Jun. 1, 1988.

*Primary Examiner* — Kevin P Kerns
(74) *Attorney, Agent, or Firm* — Standley Law Group LLP

(57) ABSTRACT

A "cold box" process for forming a foundry shape by curing a binder in a foundry mix operates by sequentially introducing a first vaporous curing catalyst to a pattern containing the formed foundry mix, followed by introducing at least a second vaporous curing catalyst. By arranging the amounts of the respective vaporous curing catalysts and the contact times, as well as by using the less active vaporous curing catalyst first, the total amount of curing catalyst used to effect the cure is reduced. Carrier gas may be used with the respective vaporous curing catalysts. Typically, the vaporous curing catalysts are tertiary amines having between three and six carbon atoms.

16 Claims, 1 Drawing Sheet

METHOD FOR CURING COLD-BOX FOUNDRY SHAPE WITH GASEOUS CATALYST

CROSS-REFERENCE TO RELATED APPLICATIONS

This application is a non-provisional patent application of U.S. Ser. No. 61/509,427, filed 19 Jul. 2011, and makes a claim of priority to that application, which is incorporated by reference as if fully recited herein.

TECHNICAL FIELD

The disclosed embodiments of the present invention relate to improvements in the device and process for curing a binder in a foundry mix, for forming a foundry shape in a so-called "cold-box" process for making cores and molds. In the improved process, at least two gaseous catalysts are used, in a sequential manner. The improved device allows the sequential use of the catalysts. In a preferred manner of practicing the present invention, the first catalyst used is less active than the second catalyst with respect to curing the binder. In many of these embodiments, the molar amount used of the first catalyst exceeds that of the second catalyst.

BACKGROUND

The use of gaseous catalysts, and especially tertiary amines, as curing agents in the cold box process of curing phenol formaldehyde and poly-isocyanate resins is known in the art.

Published US application 2010/0126690, to van Hemelryck, teaches that some of the preferred tertiary amines are trimethyl amine ("TMA", CAS RN 75-50-3), dimethyl ethyl amine ("DMEA", CAS 75-64-9), dimethylisopropylamine ("DMIPA", CAS 996-35-0), dimethyl propylamine ("DMPA", CAS RN 926-63-6) and triethyl amine ("TEA", CAS RN 121-44-8). The '690 published application teaches that, while these tertiary amines have been taught in the past as being used individually, it is possible to use the tertiary amines in blends. The blends are typically binary, but can comprise more than two tertiary amines.

The '690 published application also teaches that the preferred boiling point of the amine is below 100° C., at least when the amine is used individually, to permit evaporation and to achieve satisfactory concentration of amine in the gas mixture injected. This guideline also helps to avoid condensation of the amine in the mold.

In addition to the upper limit, there is also a lower limit of preferred boiling point. For example, TMA is a gas at ambient temperatures (bp of about 3° C.), making it more difficult to handle than the higher boiling amines. The lower molecular weight amines in general, with DMEA (bp of 44-46° C.) as a specific example, tend to have a strong ammonia odor, making them unpleasant to work with. At the other end of the boiling point spectrum, TEA (bp of 89° C.) tends to condense out of the gas mixture, especially in the winter, indicating the practical upper limit for boiling point is well below 100° C.

A parameter related to boiling point is molecular weight, which must be low enough to permit ready diffusion of the gaseous amine through the foundry mix. The '690 published application teaches that TEA (Mw 101) is at the high end of the acceptable range for the cold box process. The '690 published application teaches that a good set of acceptable curing catalysts include the set of tertiary amines with 5 carbon atoms consisting of DMIPA (bp of 64-67° C.), DMPA and N,N-diethylmethylamine ("DEMA", CAS RN 616-39-7).

In spite of the increasing understanding of these tertiary amines and their function as curing catalysts, it is still unknown how to best use the amines, especially in combinations that are not strictly mixtures.

SUMMARY

This and other unmet advantages are provided by a "cold box" process for forming a foundry shape. In the process, a foundry mix is introduced into a pattern to form the foundry shape. The foundry mix used comprises a major amount of a foundry aggregate and an uncured binder.

In the process, the formed foundry shape is contacted in a sequential manner with a first vaporous curing catalyst and then with at least a second vaporous curing catalyst. In some embodiments of the process, the second part of the contacting step uses a mixture of the first and second vaporous curing catalysts. In the process, each of the vaporous curing catalysts is capable of curing the formed foundry shape. The contacting step is conducted until the formed foundry shape is sufficiently cured to be handled, after which it is removed from the pattern. In most embodiments, a carrier gas, preferably one that is catalytically inert, moves the curing catalyst through the core box in which the foundry shape is contained.

In the preferred manner of conducting these processes, the first and second vaporous curing catalysts are selected such that, for the particular binder used, the first vaporous curing catalyst is less active than the second vaporous curing catalyst.

The preferred first and second vaporous curing catalysts are tertiary amines, especially tertiary amines with between three and six carbon atoms. Of these, triethyl amine is a preferred first vaporous catalyst, with preferred second curing catalysts including dimethylisopropylamine, dimethyl ethyl amine and dimethyl propyl amine.

In these processes, the foundry mix comprises a major amount of the foundry aggregate.

Further aspects of the invention are achieved by an apparatus or practicing the "cold box" process on a foundry shape. The apparatus has an apparatus for providing a first and a second curing catalyst in a vaporous state and a core box for containing the foundry shape being formed, the core box having an inlet and an outlet, the inlet connected to the catalyst-providing apparatus and arranged relative to the outlet to facilitate contact between the vaporous curing catalyst and the binder.

Many of the apparatuses for practicing the method will also include an apparatus for recovering the vaporous curing catalyst, connected to the outlet of the core box.

In these processes, the catalyst-providing apparatus comprises a source of a catalytically-inert carrier gas to propel the vaporous curing catalyst through the core box. In some instances, the vaporous-catalyst-providing apparatus has a first chamber for vaporizing the first catalyst and a second chamber for vaporizing the second catalyst, with each of the first and second chambers directly connected to the carrier gas source and to the inlet of the core box. In other instances, the second chamber is connected to the core box inlet through the first chamber.

When the catalyst-recovering apparatus is used, it preferably has the capacity to separate the respective first and second curing catalysts from each other, typically by utilizing a difference in boiling point or solubility.

BRIEF DESCRIPTION OF THE DRAWINGS

A better understanding of the disclosed embodiments will be obtained from a reading of the following detailed description and the accompanying drawings wherein identical reference characters refer to identical parts and in which.

DETAILED DESCRIPTION OF A PREFERRED EMBODIMENT

Figure 1:
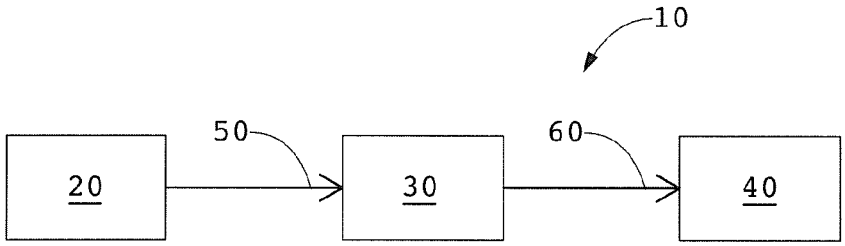
FIG. 1 is a schematic block diagram of an apparatus used to practice the cold box process using gaseous amine catalysts.

FIG. 1 shows a schematic depiction of an apparatus 10 for practicing the embodiments of the inventive concept. The apparatus 10 comprises a catalyst preparation and charging apparatus 20, a core box 30 and a catalyst recovery apparatus 40. A cold box process for producing a foundry shape such as a core or a mold generally requires a foundry mix to be formed into a desired shape inside the core box 30, after which a gaseous catalyst is passed from the catalyst preparation device 20 through conduit 50 into the core box. The catalyst interacts in the core box 30 with the foundry mix, curing a polymeric binder portion thereof, forming a cured foundry shape in the nature of a core or mold. The catalyst, usually accompanied by a carrier gas, such as nitrogen or air, exits the core box 30 through conduit 60, with the carrier gas largely determining the contact time of the catalyst with the binder. Because of regulatory requirements associated with the gaseous catalysts, the costs of the catalysts, or both factors, it is common to pass the gas stream exiting through conduit 60 into the catalyst recovery device 40, where a variety of different methods may be used to separate and recover the catalyst from the carrier gas. As an example, and relevant to many of the embodiments disclosed herein, the catalyst recovery may involve use of an acidic scrubber to neutralize a gaseous amine that has been used as the catalyst, followed by appropriate steps to recover the amine to be used again.

Figure 2:
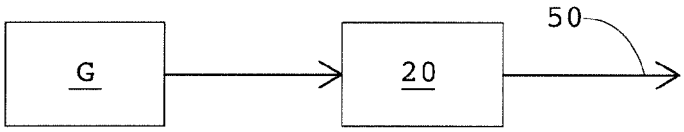
FIGS. 2 through 4 are schematic block diagrams showing further details of the catalyst preparation and charging apparatus.

In a conventional apparatus 10, the catalyst apparatus 20 needs only to provide a single curing catalyst in a vaporous condition, so a vaporizing chamber 22 and a carrier gas source G suffice, as shown in FIG. 2. However, in the methods described herein, the foundry mix in the core box is to be contacted, in a sequential manner, by a first vaporous curing catalyst and then by at least a second vaporous curing catalyst, so additional arrangements of the catalyst apparatus are depicted.

Figure 3:
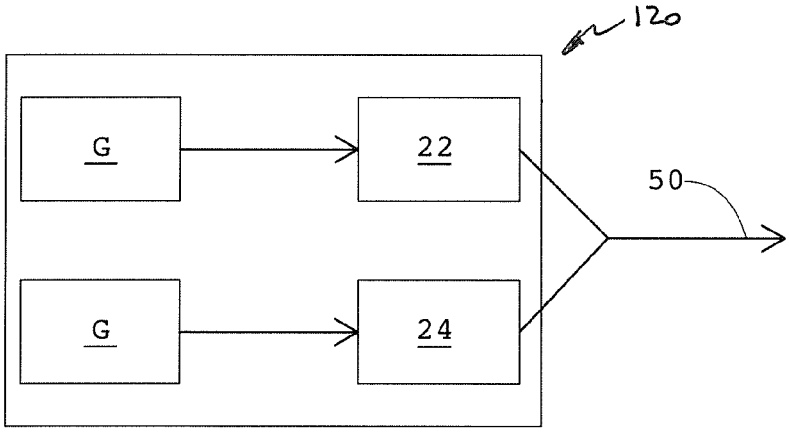

For example, in FIG. 3, the catalyst apparatus 120 has separate vaporizing chambers 22 and 24. Each vaporizing chamber 22, 24 is connected to the carrier gas source G, and the outlets of each are communicated for gas flow into conduit 50. When one of the gaseous catalysts is vaporized in chamber 22 and the other is vaporized in chamber 24, appropriate valving (not expressly shown) can cause selected sequential flow of the catalysts through conduit 50 into the core box (not shown in FIG. 3). It will be understood that the two carrier gas sources G can be a single source that is appropriately communicated to each of the chambers 22, 24 and also appropriately valved to control flow of the carrier gas.

Figure 4:
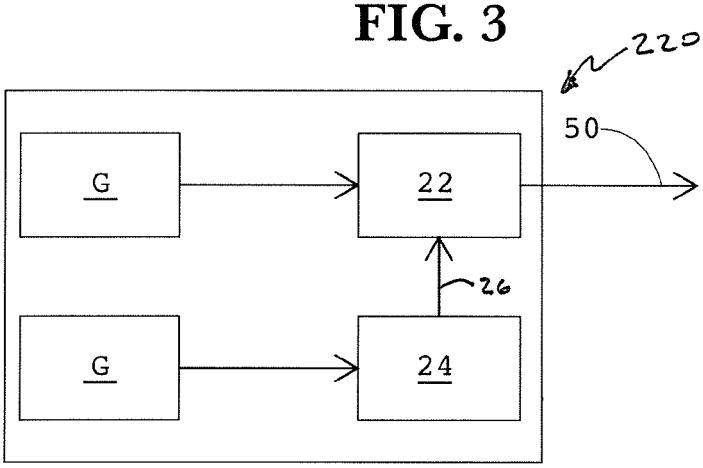

In FIG. 4, a different catalyst preparation and delivery arrangement 220 is illustrated. As with the arrangement 120, separate vaporizing chambers 22, 24 are provided and each chamber is communicated to the carrier gas supply G so that the vaporized catalyst can be driven to the conduit 50 by the carrier gas. However, in this arrangement 220, the first gaseous catalyst is vaporized in chamber 22 and the second gaseous catalyst is vaporized in chamber 24, with the chambers arranged so that the initial flow is exclusively from chamber 22 and the carrier gas source G, with the conduit 26 between chambers 22 and 24 closed. Then, by opening valving in conduit 26, flow from chamber 24 sweeps through chamber 22 on its way to conduit 50. In this manner, the first vaporous curing catalyst may be mixed with the second vaporous catalyst during the second part of the curing process.

The mechanisms involved in the embodiments disclosed herein for providing an improved curing of foundry shapes using gaseous catalysts are not fully understood, and the inventors do not propose a theory therefor, particularly with regard to the mechanisms occurring in the core box 30. However, the specifics of the process at the conduits 50, 60 of the core box are sufficiently known to define the steps involved in improving the art.

An example of the types of binders used in the cold box process is provided by U.S. Pat. No. 5,688,857 to Chen. The usefulness of amines, and especially tertiary amine gases, as the curing catalyst is also known and described in U.S. Pat. No. 3,409,579, to Robins.

EXPERIMENTAL RESULTS

Example 1

In one embodiment of the catalyst preparation device 20, the device is a vaporizer that receives the tertiary amine as a liquid, warms it and uses a carrier gas to move the amine vapor through the conduit 50 into the core box 30. This embodiment was simulated in the laboratory, using a small core box to generate the test core. Rather than using a single amine, a mixture of two amines was used. A protocol and device useful in conducting the laboratory test is described in Showman, et al, "The Need for Speed or Measurement and Optimization of Cure Speed in PUCB Binders", AFS Transactions, paper 04-02 (2004), American Foundry Society, Des Plaines, Ill. In such a circumstance, the first amine is selected primarily due to cost, with the second amine selected primarily due to higher activity. For this experiment, the first amine was TEA and the second amine was DMIPA. An amine vapor having 3 volumes of TEA to 1 volume of DMIPA was generated and moved by the carrier gas out of the catalyst preparation device and into the core box. The test core in the core box was formed from a foundry mix comprising sand and an appropriate amount of ISOCURE FOCUS™ 106/206, a foundry binder commercially available from ASK Chemicals. The gassing lasted for 12 seconds, during which 1200 μL of the amine mixture was passed through the core box. After the 12 seconds of gassing, the test core was fully cured. The test was repeated at reduced amine levels to ascertain that approximately 1200 μL was required to achieve the full cure.

Example 2

Using the same core box 30 and modifying the catalyst preparation device 120 or 220 to allow sequentially gassing, using the first amine alone and then the second amine, a foundry mix identical to that in Example 1 was placed in the core box. In the first 6 seconds, 490 μL of TEA was used to gas the core box, followed by 6 seconds of gassing with 160 μL of DMIPA, for a total of 650 μL of total amine. After this 12 second gassing, the test core was fully cured, using 550 μL less total amine.

Example 3

The experiment of Example 1 was repeated, with the only change being that the foundry mix used was sand mixed with an appropriate amount of ISOCURE FOCUS™ 112/212, also a foundry binder commercially available from ASK Chemicals. The gassing again lasted for 12 seconds and a 3:1 (by weight) mixture of TEA and DMIPA was used, resulting in full cure of the test core. In this case, the total amine vapor flow through the core box was 900 μL.

Example 4

In this experiment, the experiment of Example 3 was repeated, but the sequential gassing arrangement of Example 2 was used. A foundry mix using the ISOCURE 112/212 foundry binder was used, as in Example 3. A 6 second gassing using 450 μL of TEA was followed by a 6 second gassing with 150 μL of DMIPA, for a total of 600 μL of total amine. After this 12 second gassing, the test core was fully cured, using 300 μL less total amine.

Example 5

The experiment of Example 1 was repeated, with the only change being that the foundry mix was sand mixed with an appropriate amount of ISOCURE™ 397CL/697C, also a foundry binder commercially available from ASK Chemicals. By gassing the test core with a 3:1 (by weight) mixture of TEA and DMIPA, a full cure resulted after using 2200 μL of the amine mixture.

Example 6

The experiment of Example 5 was repeated, but the sequential gassing arrangement of Example 2 was used. The foundry mix of Example 5 was used. The sequential gassing, using 1200 μL of TEA followed by 400 μL of DMIPA, for a total of 1600 μL of total amine, resulted in a full cure.

One interpretation of this result, based on comparison with Example 5, sequential gassing used 600 μL less total amine than mixed gassing. Of the 600 μL, 450 μL would be TEA and 150 μL would be DMIPA.

Example 7

The experiment of Example 5 was repeated, using the Example 1 gassing arrangement and the ISOCURE™ 397CL/697C foundry binder. However, only TEA was used, rather than an amine mixture or sequential gassing using different amines. After gassing the test core with 3400 μL of TEA, a full cure resulted.

Comparing this result with Example 5, it is observed that TEA mixed with DMIPA is more efficacious in curing than TEA alone, since 550 μL of DMIPA in mixture with TEA effectively replaced 1750 μL TEA when TEA was used alone.

Comparing this result with Example 6, it is observed that TEA and DMIPA, sequentially used, is more efficacious in curing than TEA alone, since 400 μL of DMIPA, administered sequentially after the TEA, effectively replaced 2200 μL TEA when TEA was used alone.

Example 8

The experiment of Example 5 was repeated, using the Example 1 gassing arrangement and the ISOCURE™ 397CL/697C foundry binder. In this instance, only DMIPA was used, rather than an amine mixture or sequential gassing using different amines. After gassing the test core with 1400 μL of DMIPA, a full cure resulted.

Comparing this result to Example 5, it is observed that the mixed TEA/DMIPA cure required 800 μL more total amine, but, of that additional amine, 1650 μL of TEA replaced 850 μL of DMIPA.

Comparing this result to Example 6, it is observed that sequential administration of TEA followed by DMIPA required 200 μL more total amine. The real effect observed, however, was that 1200 μL of TEA was able to replace 1000 μL of DMIPA. This is unexpected, as comparing the result of Example 7 to Example 8 would indicate that, when used alone, DMIPA is almost 2.5 times more active or effective than TEA on a volume to volume basis.

Example 9

The experiment of Example 5 was repeated, using the Example 1 gassing arrangement and the ISOCURE™ 397CL/697C foundry binder. A different amine, the four-carbon atom dimethylethylamine ("DMEA", CAS RN 75-64-9) was used by itself, instead of DMIPA and instead of any mixture or sequential gassing. After gassing the test core with 950 μL of DMEA, a full cure resulted.

This result suggests that, when working with this foundry binder, a mixture of TEA with DMEA in a ratio similar to the 3:1 ratio of Example 5 would result in a total cure using less than the 2200 μL of total amine used in Example 5. It also suggests that about one-half of the 950 μL DMEA needed in Example 9 would be replaced by about 1500 μL of TEA.

This result also suggests that, when working with this foundry binder, the sequential gassing technique of Example 6, using TEA followed by DMEA, would result in a total cure that would use less than the 1600 μL of total amine used in Example 6. It also suggests that more than one-half of the 950 μL DMEA needed in Example 9 would be replaced by about 1100 μL of TEA.

While these examples do not use all of the amines or other related compounds known to be effective as a curing catalyst in the cold box process, the results suggest that administering a first compound in a vaporous state, followed by a second compound, also in the vaporous state, the second compound selected to be more active as a curing catalyst than the first compound, will allow effective substitution of the second compound by the first compound on an unexpectedly high volume to volume ratio.

Additional Useful Compounds

The above examples have cited as exemplary compounds tertiary amines having four carbon atoms (DMEA), five carbon atoms (DMIPA) and six carbon atoms (DEA). There are other amines containing from three to six carbon atoms that would appear to be candidates for use in the exemplary methods taught in this application.

The amines with three carbon atoms include the previously-mentioned TMA and 1-methyl aziridine (CAS 1072-44-2).

The amines with four carbon atoms include N-methylazetidine (CAS RN 4923-79-9) and 1-ethyl aziridine (CAS RN 1072-45-3).

The amines with five carbon atoms include the previously-mentioned DMPA, diethylmethylamine (DEMA) (CAS RN 616-39-7), N-propylaziridine, N-iso-propylaziridine, N-ethylazetidine, N-methylpyrrolidine (CAS RN 120-94-5) and N,N,N',N'-tetramethyl diamino methane.

The amines with six carbon atoms include the previously-mentioned TEA, N-ethyl-N-methyl 1-propanamine (CAS RN 4458-32-6), N-ethyl-N-methyl 2-propanamine (CAS RN 39198-07-7), N,N-dimethyl 1-butanamine (CAS RN 927-62-8), N,N-dimethyl 2-butanamine (CAS RN 921-04-0), N,N,2-trimethyl 1-propanamine (CAS RN 7239-24-9), N,N,2-trimethyl 2-propanamine (CAS RN 918-02-5), N-ethylpyrrolidine (CAS RN 733-06-0), N-methylpiperidine, hexamethylene tetramine, dimethyl piperazine, and N,N,N',N'-tetramethyl diamino ethane.

What is claimed is:

1. A "cold box" process for forming a foundry shape, comprising the steps of:

introducing a foundry mix into a pattern to form the foundry shape, the foundry mix comprising a foundry aggregate and an uncured binder;

contacting, in a sequential manner, the formed foundry shape with a first and at least a second vaporous curing catalyst that is chemically different from the first vaporous curing catalyst, each curing catalyst capable of curing the formed foundry shape, until the formed foundry shape is cured to a handleable condition; and removing the formed and cured foundry shape from the pattern.

2. The process of claim 1, wherein:

the sequential contacting step comprises the substeps of:

contacting the foundry shape with a gas comprising the first vaporous curing catalyst, with or without a catalytically-inert carrier gas and substantially devoid of the second vaporous curing catalyst, resulting in a partially-cured foundry shape; and contacting the partially-cured foundry shape with a gas comprising the second vaporous curing catalyst, with or without a catalytically-inert carrier gas.

3. The process of claim 2, wherein:

the first and second vaporous curing catalysts are selected such that, for the binder, the first vaporous curing catalyst is less active than the second vaporous curing catalyst.

4. The process of claim 3, wherein:

each of the first and second vaporous curing catalysts is a tertiary amine.

5. The process of claim 1, wherein:

each of the first and second vaporous curing catalysts is a tertiary amine.

6. The process of claim 5, wherein:

each of the first and second vaporous curing catalysts has between three and six carbon atoms.

7. The process of claim 6, wherein:

the first vaporous curing catalyst is triethyl amine.

8. The process of claim 7, wherein:

the second vaporous curing catalyst is dimethyl isopropyl amine.

9. The process of claim 7, wherein:

the second vaporous curing catalyst is dimethyl ethyl amine.

10. The process of claim 7, wherein:

the second vaporous curing catalyst is dimethyl propyl amine.

11. The process of claim 6, wherein:

the second vaporous curing catalyst is dimethyl isopropyl amine.

12. The process of claim 6, wherein:

the second vaporous curing catalyst is dimethyl ethyl amine.

13. The process of claim 6, wherein:

the second vaporous curing catalyst is dimethyl propyl amine.

14. The process of claim 1, wherein:

the first and second vaporous curing catalysts are selected such that, for the binder, the first vaporous curing catalyst is less active than the second vaporous curing catalyst.

15. The process of claim 14, wherein:

each of the first and second vaporous curing catalysts is a tertiary amine.

16. A "cold box" process for forming a foundry shape, comprising the steps of:

introducing a foundry mix into a pattern to form the foundry shape, the foundry mix comprising a foundry aggregate and an uncured binder;

contacting, in a sequential manner, the formed foundry shape with a first and at least a second vaporous curing catalyst that is chemically different from the first vaporous curing catalyst, each vaporous curing catalyst being a tertiary amine with between three and six carbon atoms and capable of curing the formed foundry shape, until the formed foundry shape is cured to a handleable condition; and removing the formed and cured foundry shape from the pattern.

* * * * *